US006036787A

United States Patent [19]

Bennett et al.

[11] Patent Number: 6,036,787

[45] Date of Patent: Mar. 14, 2000

[54] STENCIL CLEANING APPARATUS

[75] Inventors: Ricky Bennett, Flemington, N.J.; Richard Leiske, Winona, Minn.

[73] Assignee: DEK Printing Machines, Ltd., Weymouth Dorset, United Kingdom

[21] Appl. No.: 09/114,615

[22] Filed: Jul. 13, 1998

[51] Int. Cl.[7] ..... B41F 35/00

[52] U.S. Cl. ..... 134/21; 134/15; 15/308; 15/309.2; 101/423; 101/425

[58] Field of Search ..... 15/97.1, 102, 103.5, 15/100, 256.5, 256.1, 308, 306.1, 309.1, 309.2; 101/423, 425; 134/15, 21

[56] References Cited

U.S. PATENT DOCUMENTS

| | | | |
|---|---|---|---|
| 3,620,230 | 11/1971 | Foret | 15/308 |
| 3,641,605 | 2/1972 | Lindsay | 15/100 |
| 4,010,514 | 3/1977 | Fischer et al. | 15/100 |
| 4,953,252 | 9/1990 | Akisawa | 15/308 |
| 5,197,384 | 3/1993 | Yawata et al. | 101/423 |
| 5,485,781 | 1/1996 | Rovaris | 101/425 |
| 5,491,871 | 2/1996 | Reber et al. | 15/308 |
| 5,657,693 | 8/1997 | Kumaki et al. | 101/423 |
| 5,802,976 | 9/1998 | Friedrichs | 101/425 |
| 5,918,544 | 7/1999 | Doyle | 101/423 |

*Primary Examiner*—Terrence R. Till
*Assistant Examiner*—Theresa T. Snider

[57] ABSTRACT

An adapter for converting an existing under screen cleaning apparatus from one which uses a solvent to a solventless under screen cleaning apparatus. The adapter fits within the vacuum channel and between the blades of a known under screen cleaning apparatus. The adapter extends above the top edges of the blades and provides a top surface with at least three lands and a plurality of slots. An interior hole within the adapter connects the slots with a vacuum outlet of the vacuum channel. Optionally, suction is applied to the slots by pumping air from the vacuum outlet.

14 Claims, 9 Drawing Sheets

STENCIL CLEANING APPARATUS

FIELD OF THE INVENTION

The present invention relates generally to the field of automated screen printers for applying paste materials to substrates such as printed circuit boards using a perforated screen or stencil. More particularly, the present invention is directed to an apparatus for cleaning the underside of a stencil in such an automated screen printer without the use of a solvent.

BACKGROUND

A known method for fabricating electrical circuits is to apply an adhesive solder paste to selected areas of a printed circuit board and then to place circuit components on the applied paste. The circuit board is heated to melt the solder paste. The melted solder wets metallic surfaces on the components and the circuit board. When the board is cooled the solder solidifies bonding the components to the circuit board and forming the electrical circuits.

Solder paste is applied through a stencil or screen with holes positioned to correspond to the areas where the components are to be connected with the circuit board. The circuit board is arranged below the stencil and aligned with the stencil holes. Solder paste is applied to the top surface of the stencil and a portion of the paste is forced through the stencil holes. This paste adheres to the circuit board. The circuit board is then removed from the stencil and replaced with a new circuit board and the process repeated. This process is most economically performed using automated machinery. For example, an automated apparatus for forming printed circuit boards using a stencil to apply solder paste is described in co-pending U.S. patent application Ser. No. 09/075,093, filed May 8, 1998.

In order to form reliable circuits using the screen printing technique it is critical that the stencil and the circuit board come in close contact during the printing process. Debris between the stencil and the board can cause solder paste to spread from its intended contact areas, resulting in short circuits. Further, debris within the holes of the stencil will prevent solder paste from flowing to the circuit board and will result in voids in the applied solder paste layer.

Debris is removed from the stencil by periodically wiping the bottom surface of the stencil with a fabric or paper sheet. In order to assure that the stencil surface is adequately cleaned a solvent is applied to the sheet.

FIG. 1 shows an apparatus 2 for wiping the bottom surface of a stencil 14. A cleaning sheet 1 is fed from a supply roll 3 and through a set of tensioning rollers 5. Solvent is applied to the sheet 1 by a solvent bar 11. The solvent is pumped into the solvent bar 11 by a pump (not shown) and sprays from the solvent bar 11 through jets 9 toward the sheet 1. The sheet 1 passes over a pair of flexible blades 13 which press the sheet 1 against the stencil 14. A vacuum channel 15 supports the blades 13. Suction is optionally applied to the vacuum channel 15 to pull the stencil 14 tightly against the sheet 1 as air is pumped from the channel 15 through an outlet tube 17. The sheet 1 then passes through a second set of tensioning rollers 19 and is taken up on a take-up roll 21. Cross members 16 are disposed across the width of the vacuum channel 15.

FIG. 2 shows a top view of the blades 13 and vacuum channel 15 shown in FIG. 1. The cross section of FIG. 1 is taken along line A in FIG. 2. A number of cross members 16 are disposed across the vacuum channel 15.

To wipe the stencil 14 the sheet 1 is advanced past the solvent bar 11 to apply solvent to the portion of the sheet 1 which will be positioned between the blades 13 and the stencil 14. The apparatus 2 is then moved as shown by arrows 23 so that the blades 13 wipe the solvent-laden sheet 1 across the stencil 14. Optionally, suction applied via the vacuum channel 15 increases the force between the sheet 1 and the stencil 14.

The DEK 256 GS Automatic Underscreen Cleaner, manufactured by DEK U.S.A., Inc., the assignee of the present invention, is an example of such an apparatus.

The use of solvent in the above apparatus facilitates the removal of debris, particularly dried solder paste. Without the use of the solvent, wiping using the above apparatus is unreliable. The use of solvents, however, presents a number of problems in the manufacturing process. Many solvents contribute to environmental pollution and are hazardous to workers. Certain solvent vapors can cause smog or contribute to ozone destruction in the upper atmosphere. Many solvents are toxic and/or highly flammable. As such, their use is heavily regulated and regulatory compliance increases the cost of manufacturing circuit boards. Less hazardous solvents are available but they are expensive and less effective in removing dried solder paste.

The apparatus described with reference to FIG. 1 can be used without applying a solvent to the sheet. The result, however, is that cleaning of the stencil is less effective and a greater number of unreliable solder joints are formed on the finished printed circuit board.

The amount of solvent that is required for the process can be reduced with acceptable reliability if workers periodically wipe the stencil by hand using a solvent soaked cloth instead of applying solvent to the automated wiping apparatus shown in FIG. 1. This procedure presents other difficulties, however. Hand wiping presents a health risk to workers by increasing their exposure to metals, particularly lead, in the solder paste. In addition, hand wiping requires that the automated machinery be stopped so that a worker can reach into the apparatus. Stopping the screen printer to wipe the stencil may result in idling equipment used in subsequent processing steps thus decreasing the productivity of the production line.

SUMMARY OF THE INVENTION

The present invention is directed to a stencil cleaning apparatus that does not suffer from the above-mentioned problems. It is an object of the present invention to provide a stencil cleaning apparatus that effectively removes debris from the surface of a stencil without the use of a solvent.

It is another object of the present invention to provide a solventless stencil cleaning apparatus that operates in-line within an automated screen printer so that periodic cleaning of the stencil can be accomplished without stopping production.

It is yet another object of the present invention to provide an adapter for rapidly and inexpensively converting a known stencil cleaning apparatus that requires the use of a solvent to a solventless stencil cleaning apparatus.

According to an aspect of the present invention there is provided a supply roll for holding a continuous roll of a porous cleaning sheet. The cleaning sheet feeds from the supply roll between a pair of tensioning rollers, the tensioning rollers traversing the width of the sheet. The sheet passes over an elongated cleaning head, the cleaning head also traversing the width of the sheet and supporting the sheet against tension supplied by the tensioning rollers. The cleaning head is provided with a plurality of parallel horizontal lands extending lengthwise along the top surface of the head for supporting the sheet, the horizontal lands extending substantially across the width of the sheet. Slots separate the lands. The slots are connected with a vacuum source to provide suction through the pores of the sheet.

The cleaning head is formed by inserting an adapter between the blades and within the vacuum channel of a known stencil cleaning apparatus. The adapter is formed with the lands and slots on its top surface and a number of interior holes extending from the bottom and connecting with the slots. The interior holes communicate suction from the vacuum channel to the slots.

The sheet passes between a second pair of tensioning rollers traversing the width of the sheet and winds onto a take-up roll. Motors drive the supply roll and the take-up roll so that the sheet can be controllably advanced from the supply roll, across the cleaning head, and onto the take-up roll. The supply roll, first and second pairs of tensioning rollers, cleaning head, take-up roll and motors are mounted to a carriage which can move in a horizontal direction perpendicular to the width of the cleaning sheet.

The apparatus is positioned so that the parallel horizontal lands of the cleaning head press the cleaning sheet against the bottom surface of a stencil of an automated screen printer. The carriage moves along the length of the stencil so that the cleaning sheet is wiped across the surface of the stencil. The vacuum source optionally applies suction to the slots to increase the force between the stencil and the cleaning sheet.

According to a second aspect of the present invention, instead of forming the cleaning head using an adapter inserted into a vacuum channel, the cleaning head is formed from a single body. The adapter has a plurality of lands and slots similar to the top surface of the cleaning head according to the first aspect.

BRIEF DESCRIPTION OF THE DRAWINGS

Further features and advantages of the invention will be apparent upon consideration of the following detailed description of the present invention taken in conjunction with the following drawings, in which like reference characters refer to like parts, and in which.

DETAILED DESCRIPTION

Figure 3:
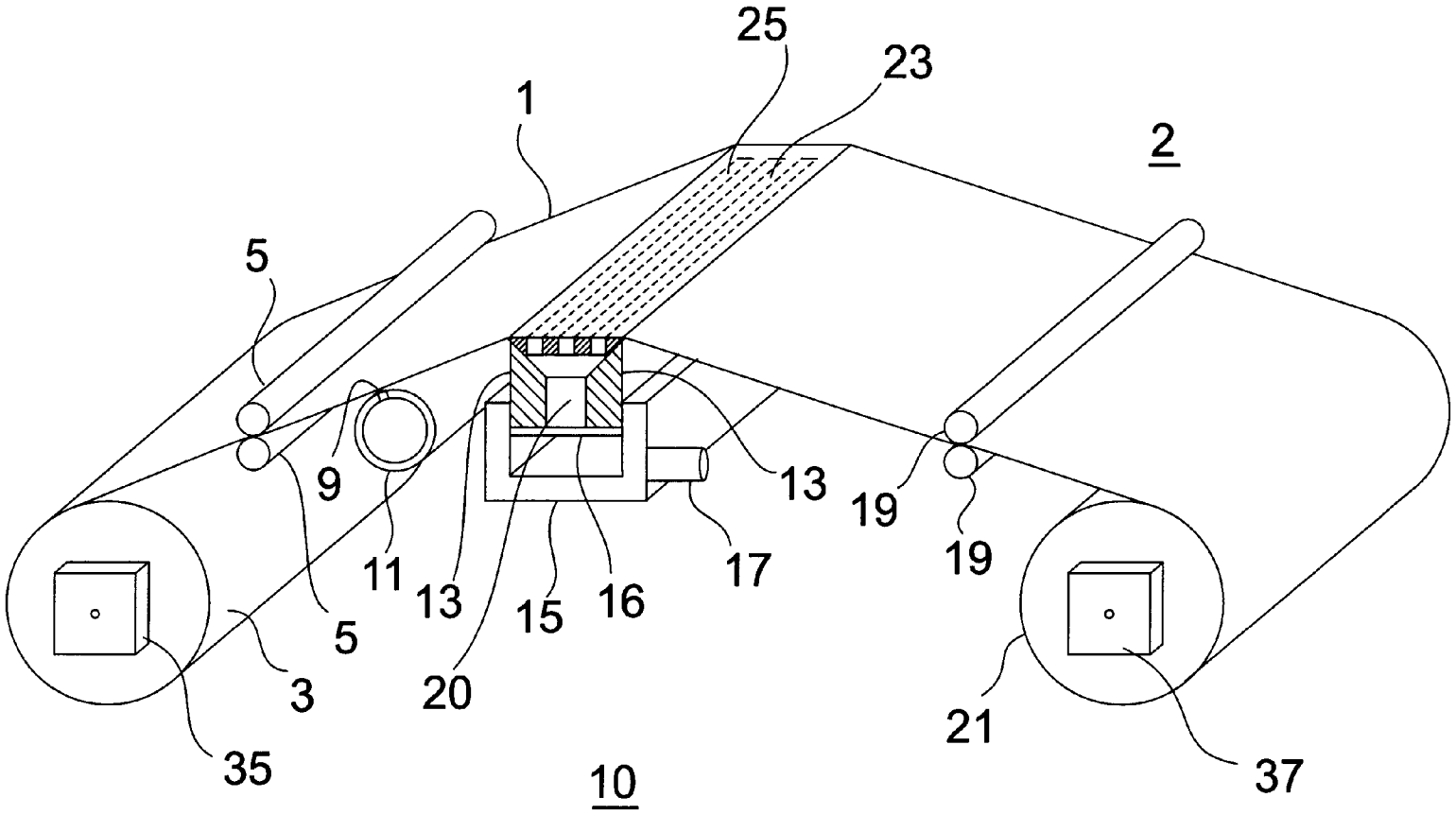
FIG. 3 is a perspective view of an apparatus according to a first embodiment of the present invention.

FIG. 3 shows an apparatus 10 for wiping the surface of a stencil of a screen printer according to a first embodiment of the present invention. A cleaning sheet 1 is held on a supply roll 3. The sheet 1 passes between a pair of tensioning rollers 5. The sheet 1 passes over an adapter 20 disposed between the blades 13 of the apparatus shown in FIG. 1. The sheet 1 then passes through a second set of tensioning rollers 19 and is wound onto a take-up roll 21. A take-up roll motor 37 rotates the take-up roll 21 to advance the sheet 1 from the supply roll 3 to the take-up roll 21. A drag mechanism 35 allows the supply roll 3 to rotate against a frictional torque, thereby preventing the supply roll 3 from freewheeling. A solvent bar 11 is disabled so that no solvent is applied to the sheet 1.

Figure 4:
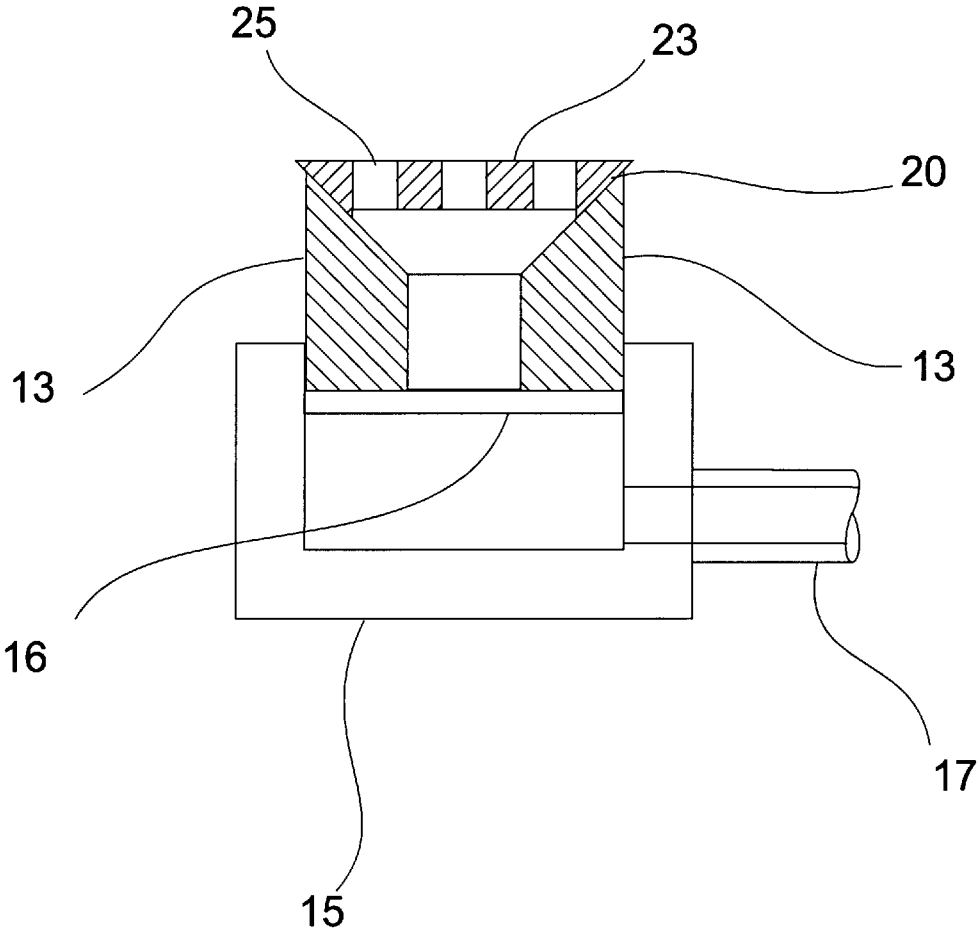
FIG. 4 is a detailed cross section of a portion of the apparatus of FIG. 3.
Figure 6:
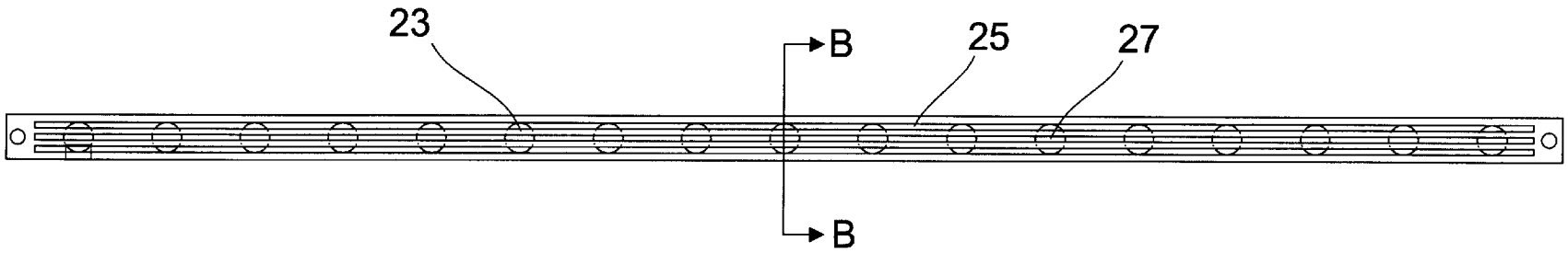
FIG. 6 is a top view of the adapter of FIG. 5.
Figure 5:
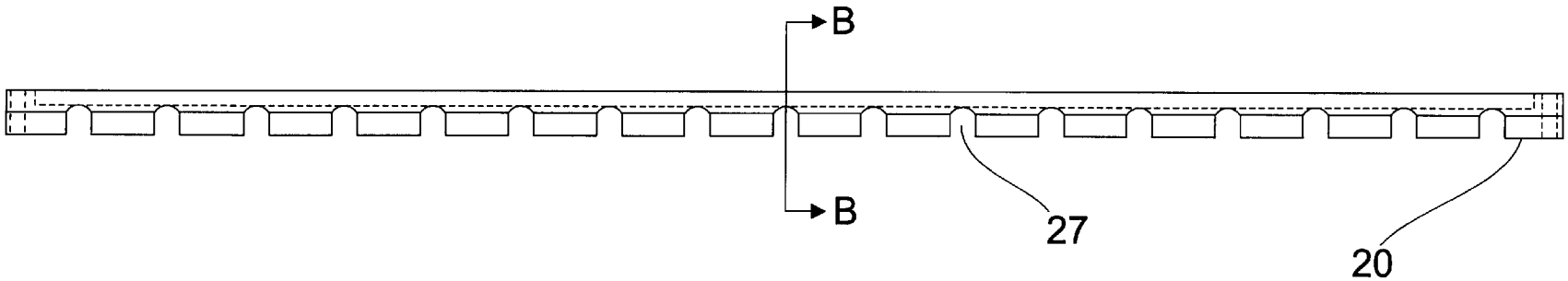
FIG. 5 is a side view of an adapter for use in the embodiment of FIG. 3.

The adapter 20 is shown in detail in FIGS. 4–6. FIG. 4 shows a cross sectional view of the adapter 20 disposed between the blades 13. The bottom of the adapter 20 rests on the cross members 16 within the vacuum channel 15. Below the bottom surface of the adapter 20 an outlet tube 17 extends through the side of the vacuum channel 15. At least two slots 25 are cut into the top surface of the adapter 20. Between these slots 25 are at least three lands 23. FIGS. 4–6 show a preferred embodiment wherein three slots 25 and four lands 23 are provided on the top surface of the adapter 20. As illustrated, the top surface of the adapter 20 extends above the top edges of the blades 13. The adapter 20, rather than the blades 13 press the cleaning sheet 1 against the stencil 14.

FIG. 5 shows a side view of the adapter 20. FIG. 6 shows a top view of the adapter 20. The cross section shown in FIG. 4 is along the line B shown in FIGS. 5 and 6. The slots 25 are intersected by interior holes 27. A number of interior holes 27 are provided along the length of the adapter 20 to communicate suction from the vacuum channel 15 to the vacuum slots 25.

Figure 1:
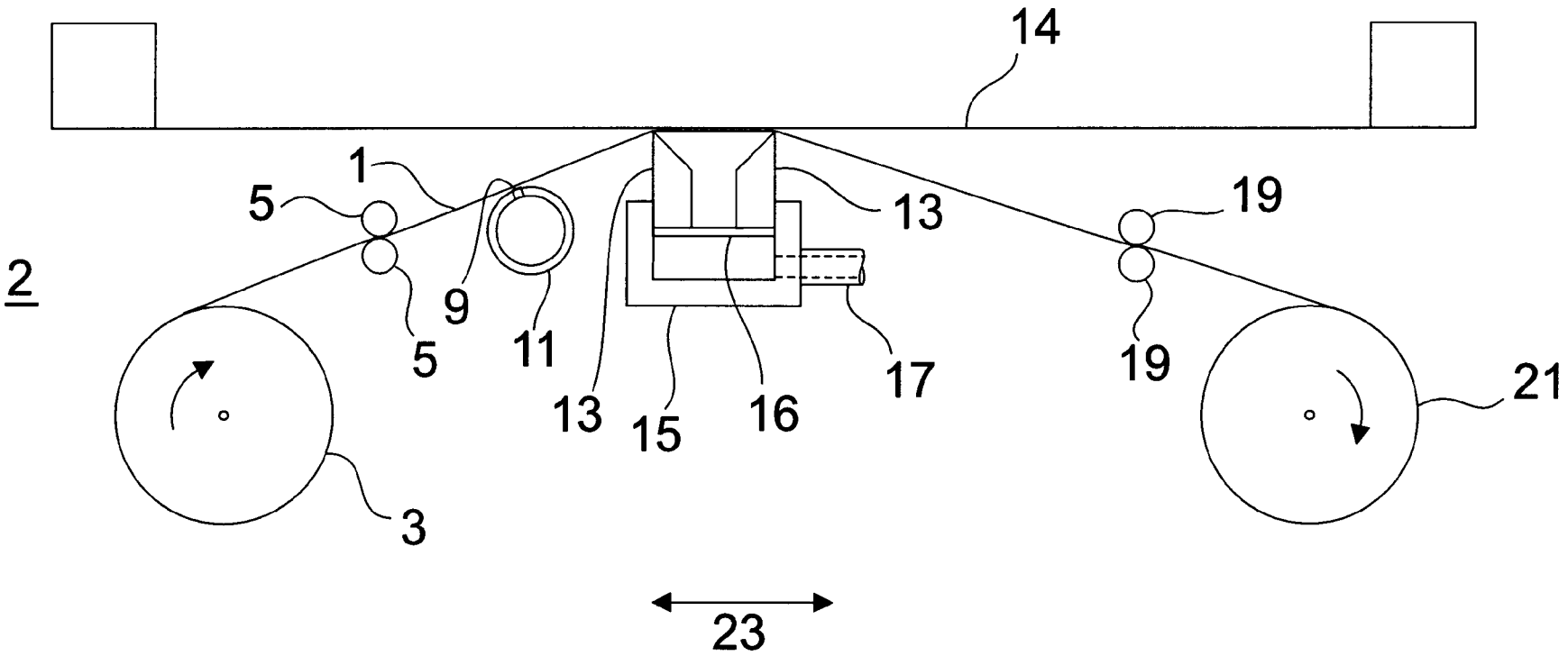
FIG. 1 PRIOR ART
FIG. 1 schematically shows a cross sectional view of an apparatus for wiping a stencil in an automated screen printing device according to the prior art.
Figure 2:
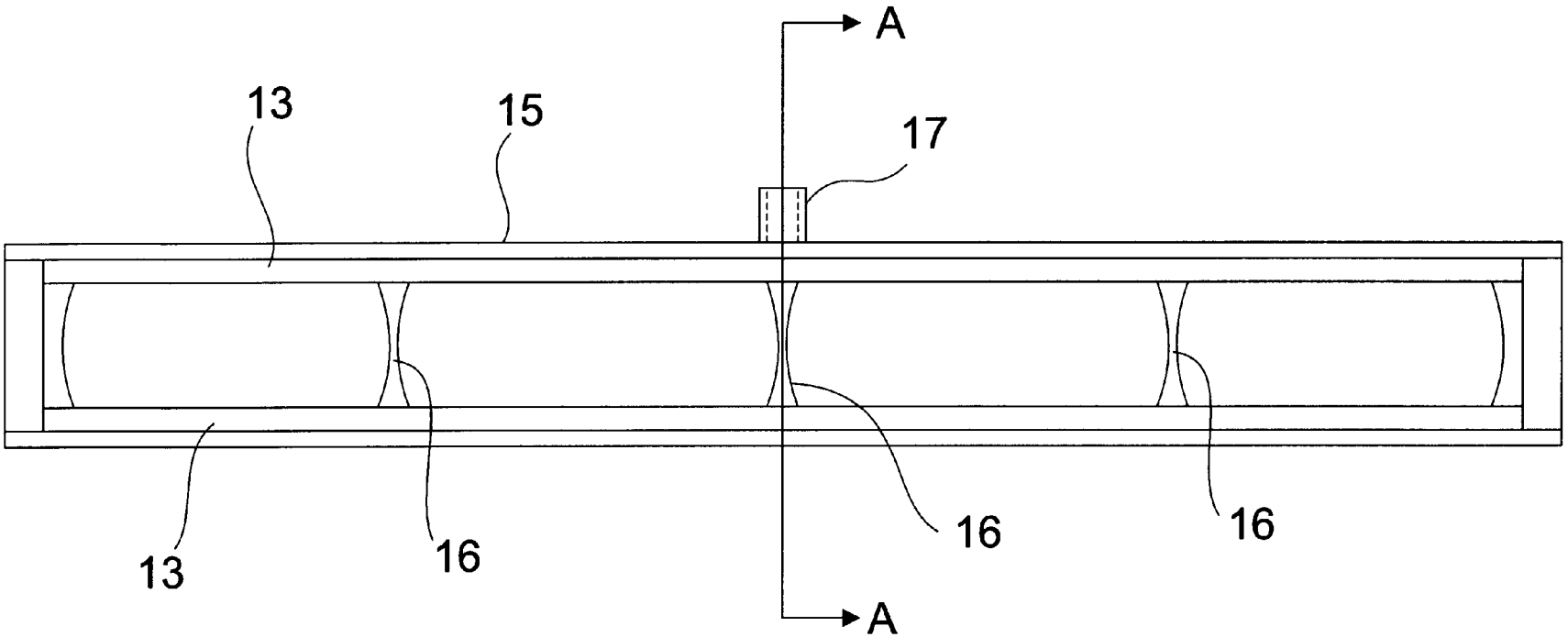
FIG. 2 PRIOR ART
FIG. 2 is a top view of a portion of the apparatus shown in FIG. 1.

As shown in FIG. 2, the vacuum channel 15 of the apparatus shown in FIG. 1 is crossed by a number of cross members 16. As shown in FIG. 4, when the adapter 20 is disposed between the blades 13, the lower surface of the adapter 20 is supported by the cross members 16. Further, the adapter 20 is shaped so that it fits snugly between the blades 13 so that an air-tight seal forms between the adapter 20 and the vacuum channel 15. Suction applied to the outlet tube 17 draws air from the slots 25 via the interior holes 27.

The cleaning sheet 1 may be selected from a number of materials designed to trap debris. Such materials include synthetic foam, woven cloth, and bonded fibrous materials such as paper or vellum. The material forming the cleaning sheet 1 is selected to be hold a large amount of solder paste without smearing and to wipe the stencil 14 without creating loose fibers. The cleaning sheet may be, for example NOVATECH 7000 fabric manufactured by High-Tech Conversions, Inc.

Figure 7:
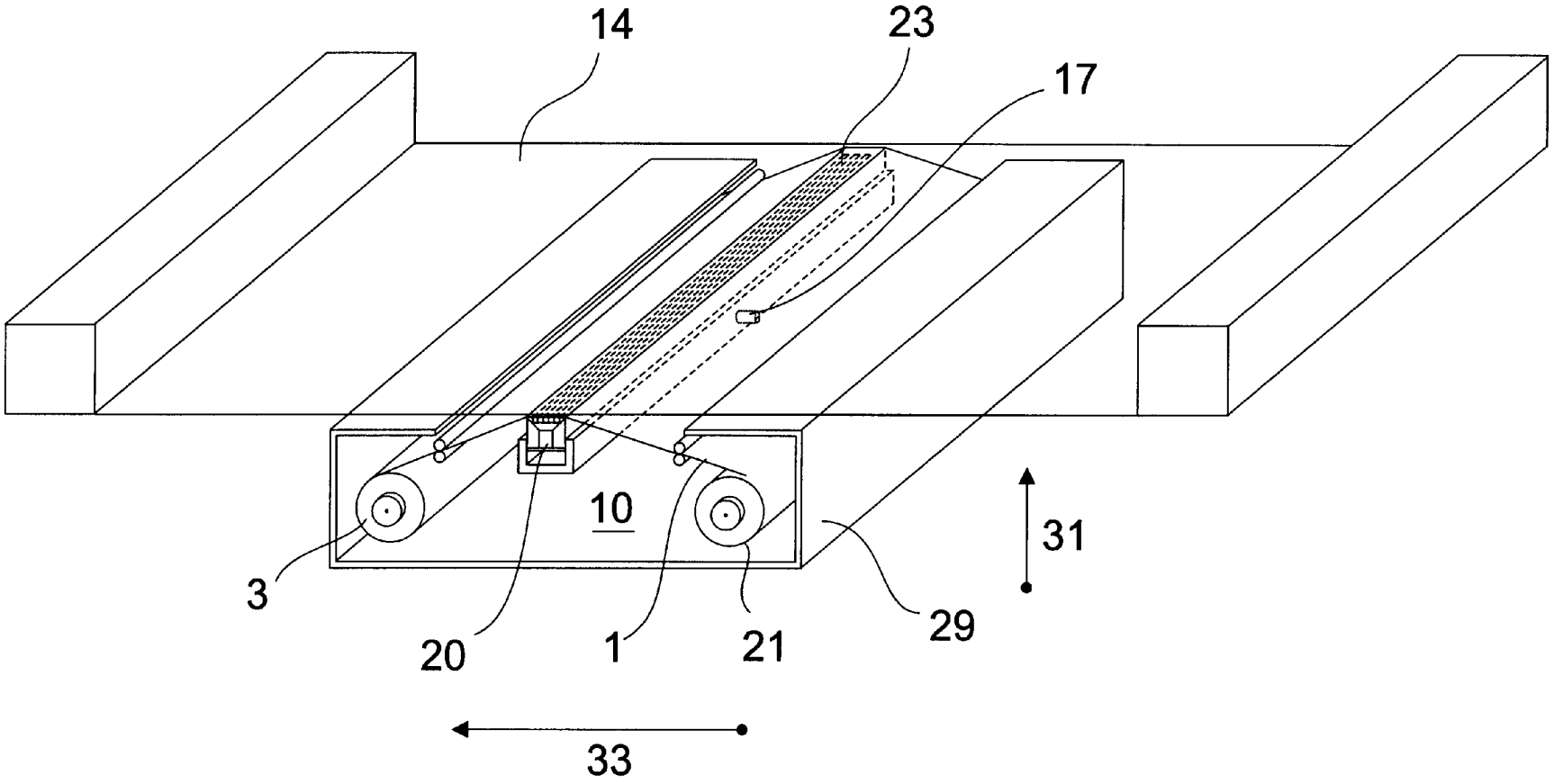
FIG. 7 is a perspective view of the apparatus of FIG. 3 disposed in a carriage for motion relative to a stencil.

FIG. 7 shows the wiping apparatus 10 according to the present invention in contact with a stencil 14. The lands 23 of the adapter 20 press the sheet 1 against the stencil 14. Optionally, vacuum may be applied to the outlet tube 17 by a pump (not shown) to pull the stencil 14 against the sheet 1 with additional force.

The apparatus 10 is disposed in a carriage 29. The carriage 29 is supported by a mechanism (not shown) which controllably moves the apparatus 10 in the directions indicated by arrows 31 and 33.

Figure 8A:
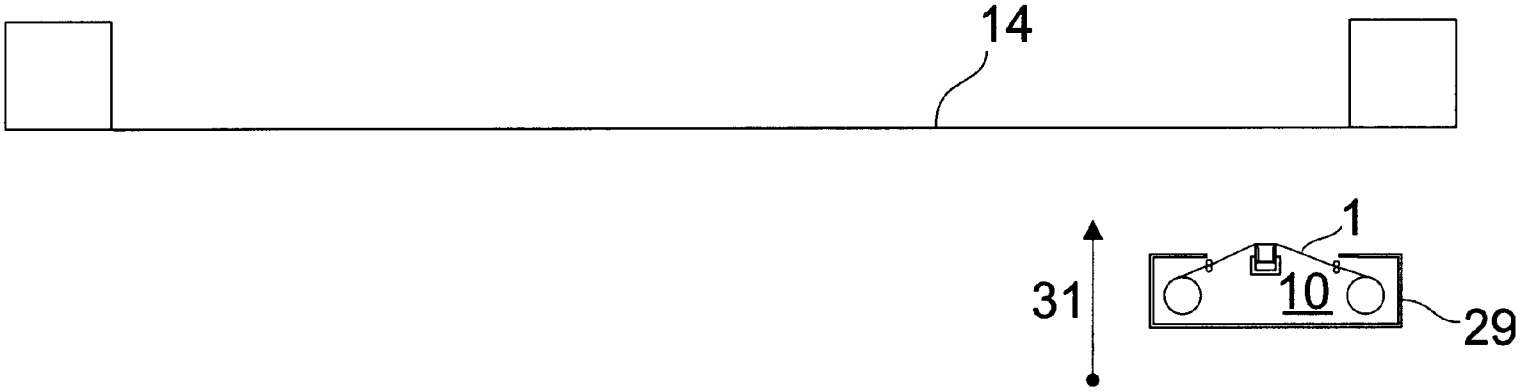
FIGS. 8(*a*) and 8(*b*) are side views of the apparatus shown in FIG. 7 illustrating a cleaning cycle.
Figure 8B:
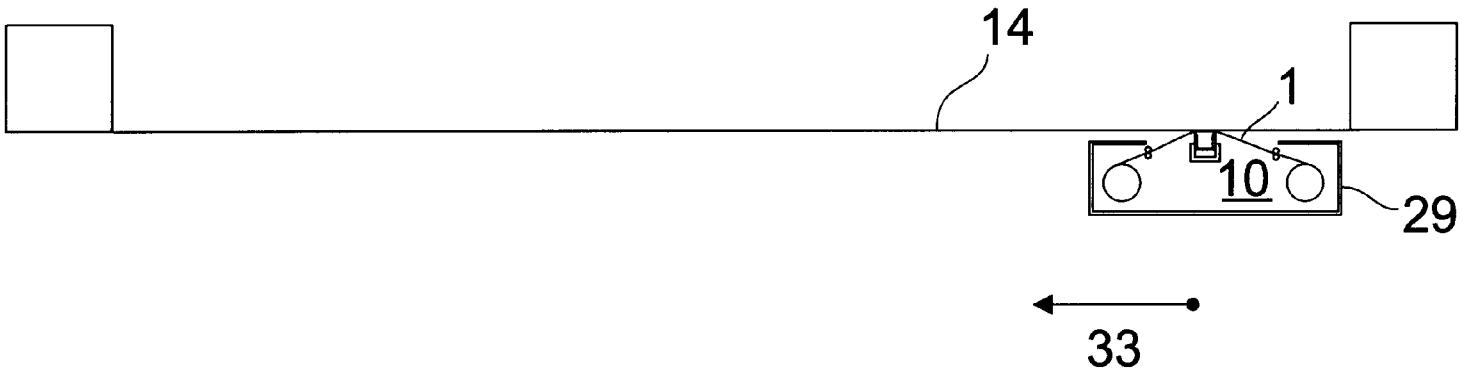

FIG. 8(*a*) shows the position of the apparatus 10 and carriage 29 while the stencil 14 is being used to print a circuit board (not shown). The carriage 29 and apparatus 10 are at one end of the stencil 14 and the sheet 1 is not in contact with the stencil 14. In this position the apparatus 10 and carriage 29 do not interfere with the screen printing process.

When the screen printing process is complete the carriage 29 moves the apparatus 10 in the direction shown by arrow 31 so that the sheet 1 contacts the stencil 14 as shown in FIG. 8(*b*). The lands 23 of the adapter 20 press the sheet 1 against the stencil 14. Vacuum may be applied to the vacuum channel 15 to increase this force. The carriage 29 moves the apparatus 10 along the stencil 14 in the direction indicated by arrow 33. When the carriage 29 reaches the opposite end of the stencil 14, the apparatus 10 is lowered away from the stencil 14 and returned to the position shown in FIG. 8(*a*). The take-up roll motor 37 is then actuated to advance the sheet 1 from the supply roll 3 to the take-up roll 21 so that a new section of the sheet 1 is disposed over the top of the adapter 20. Tension supplied by the first and second tensioning rollers 5 and 19 keeps the sheet 1 taut over the top of the adapter 2. Alternatively tension can be supplied to the sheet 1 using only torque applied by the drag mechanism 35 and the take-up roll motor 37.

The cleaning apparatus 10 according to the present invention is able to effectively clean the stencil 14 without using a solvent because the lands 23 provide a greater contact area between the stencil 14 and the cleaning sheet 1 than is provided by the blades 13 of the apparatus shown in FIG. 1. Because a greater area of the cleaning sheet 1 is used to remove debris, a greater load of debris can be trapped on the surface of the sheet 1. It is therefore not necessary to use a solvent to dissolve the debris and transport it into the bulk of the sheet 1.

Figure 9:
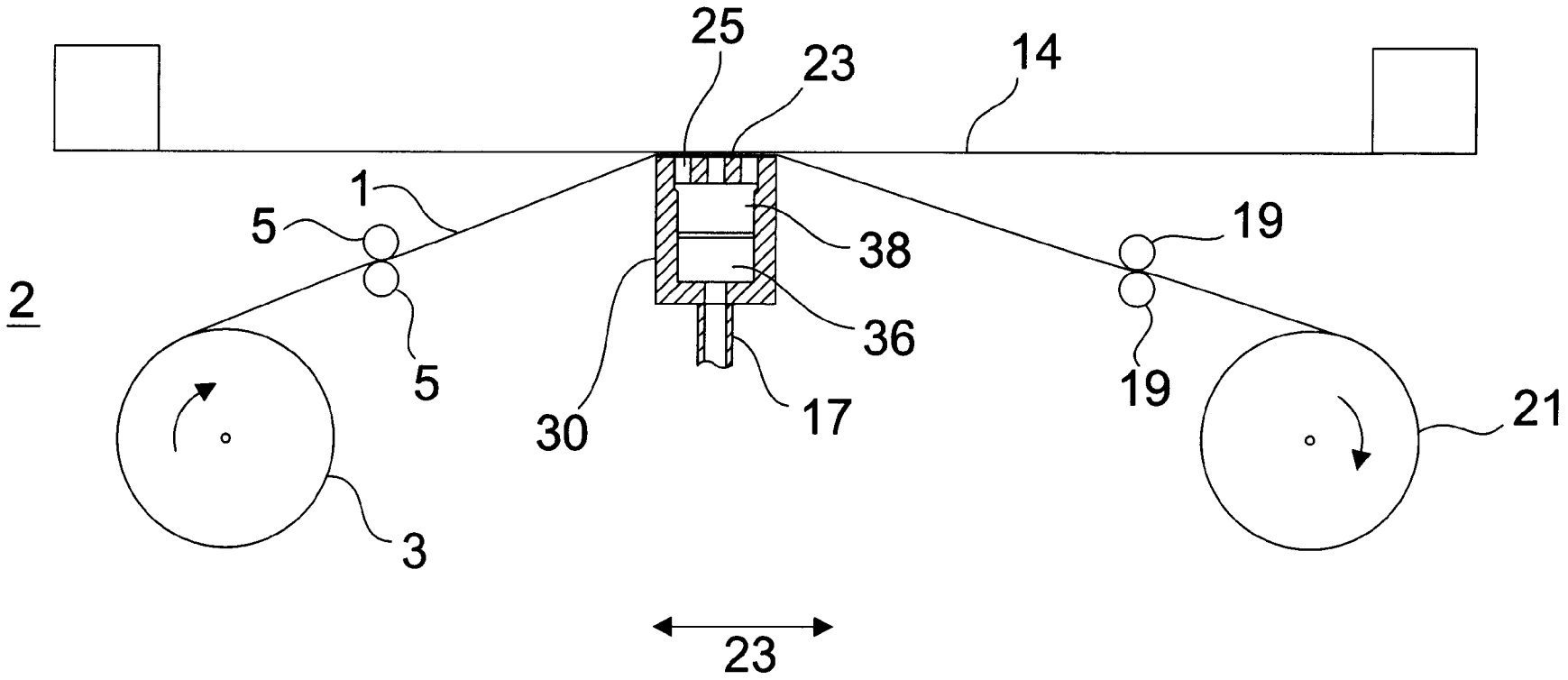
FIG. 9 is a perspective view of an apparatus according to a second embodiment of the present invention.

FIG. 9 shows a cross section of an apparatus according to a second embodiment of the present invention. This embodiment is similar to the previously described embodiment except that the adapter 20 and vacuum channel 15 are formed as a single unit. Elements which are the same as in the previous embodiment are, therefore, designated with the same numerals.

A cleaning sheet 1 is fed from a supply roll 3 to a take up roll 21 in the same manner as in the previous embodiment. The sheet 1 is disposed against lands 23 formed on a top surface of a cleaning head 30. Slots 25 separate the top surface of the head 30 into a number of lands 23. A cavity 36 is formed within a lower section of the head 30 and a number of interior holes 38 are formed between and connect the cavity 36 to the slots 25.

Figure 10:
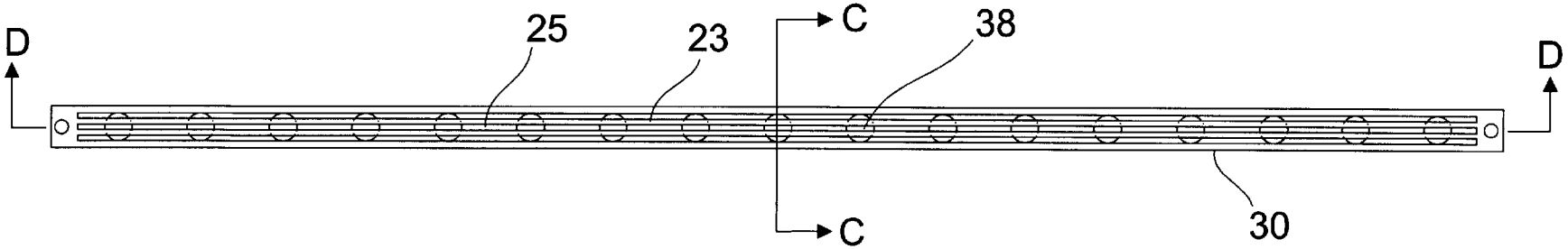
FIG. 10 is a top view of a cleaning head used in the embodiment of FIG. 9.
Figure 11:
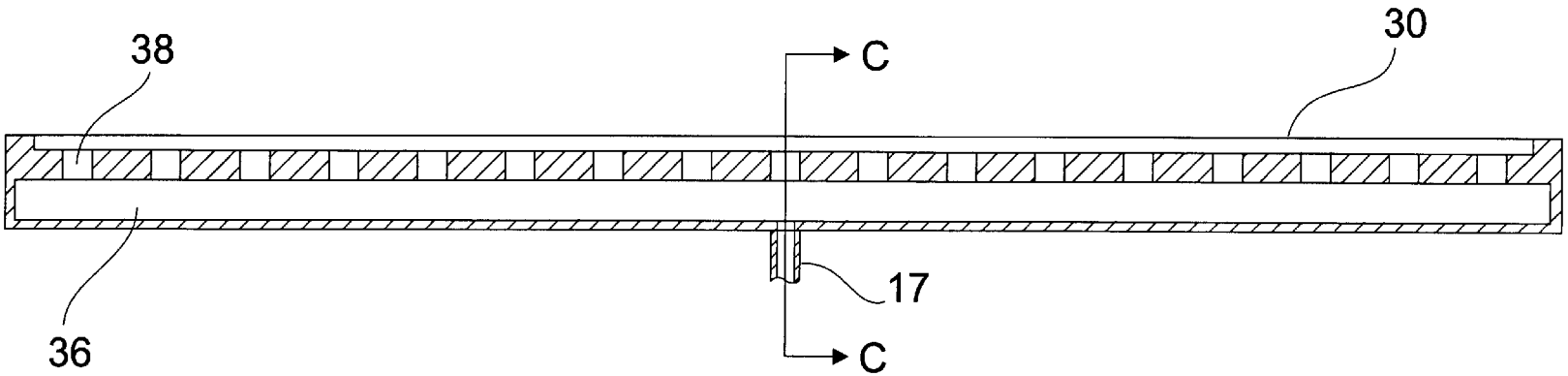
FIG. 11 is a cross sectional side view of the cleaning head of FIG. 10.

FIG. 10 shows a top view of the cleaning head 30. The cross section shown in FIG. 9 is taken along line C. FIG. 11 shows a cross sectional view of the cleaning head 30 taken along line D of FIG. 10. The cavity 36 connects the interior holes 38 with an outlet tube 17. Optionally, air is pumped from the outlet tube 17 evacuating the cavity 36 and causing suction to be applied to the slots 25 via the interior holes 38.

Cleaning of the stencil 14 is accomplished in the same manner as in the first embodiment as described with reference to FIGS. 8(*a*) and 8(*b*).

The above embodiments are illustrative of the present invention. While these are presently considered the most practical and preferred embodiments, it is to be understood that the invention is not limited by this disclosure. This invention is intended to cover various modifications and equivalent arrangements included within the spirit and scope of the appended claims.

I claim:

1. A cleaning apparatus for cleaning a stencil of a screen printer without using a solvent, the cleaning apparatus comprising:

a cleaning head with a top surface, the top surface including at least three lands and a plurality of slots interposed between the lands;

a cleaning sheet disposed over the lands on the top surface of the cleaning head; and a carriage operable to hold the cleaning head and cleaning sheet against the stencil and to move the cleaning head and cleaning sheet relative to the stencil.

2. The cleaning apparatus according to claim 1 further comprising a cavity in pneumatic communication with the slots for applying suction to the slots.

3. The cleaning apparatus according to claim 1 wherein the top surface of the cleaning head includes three slots and four lands.

4. The cleaning head according to claim 1 wherein the cleaning sheet is composed of a fabric.

5. The cleaning apparatus according to claim 1 further comprising:

a supply roll disposed on the carriage parallel to the cleaning head holding a first end of the cleaning sheet and wrapped with a supply of the cleaning sheet, the supply roll rotatably mounted to unwind the cleaning sheet toward the cleaning head;

a take-up roll disposed on the carriage parallel to the cleaning head and on an opposite side of the cleaning head from the supply roll holding a second end of the cleaning sheet and rotatably driven to wind the cleaning sheet, wherein winding of the cleaning sheet onto the take-up roll advances the cleaning sheet from the supply roll so that a new segment of the cleaning sheet is disposed over the top of the cleaning head; and tension applying means for applying tension to the cleaning sheet, wherein the cleaning sheet is held taut over the top of the cleaning head.

6. An adapter for use in an under screen cleaning apparatus of a screen printer, the adapter comprising:

an elongated adapter body;

at least three elongated lands disposed on a top surface of the adapter body with a plurality of slots interposed between the lands and penetrating into the adapter body, the lands extending along the length of the adapter body; and an interior hole extending from a bottom surface of the adapter body into the adapter body, wherein the interior hole intersects with the plurality of slots forming a pneumatic connection between the slots and the interior hole, wherein the adapter body is shaped to fit within a vacuum channel and between elongated blades of the under screen cleaning apparatus so that an air tight seal forms between the adapter and the blades.

7. The adapter according to claim 6 wherein four lands are provided on the adapter body.

8. The adapter according to claim 6 further comprising a means for holding a cleaning sheet against the lands.

9. The adapter according to claim 8 wherein the means for holding the cleaning sheet includes means for moving the cleaning sheet relative to the adapter.

10. A method for cleaning a stencil of a screen printer, the method comprising the steps of:

arranging a cleaning sheet against a top surface of a cleaning head, the top surface of the cleaning head including at least three lands;

pressing the cleaning sheet against a surface of the stencil with the lands; and moving the cleaning sheet and cleaning head relative to the stencil.

11. The method according to claim 10 wherein the lands are separated from one another by a plurality of slots and wherein the slots are pneumatically connected to a vacuum channel.

12. The method according to claim 11 wherein the step of pressing includes the step of pumping air from the vacuum channel.

13. The method according to claim 10 wherein the cleaning sheet is formed as a continuous web, a first portion of the web being arranged against the lands and further comprising the steps of:

positioning the cleaning head apart from the surface of the stencil; and advancing the continuous web from a supply roll across the lands to a take up roll, wherein the first portion of the web is moved away from the cleaning head and toward the take up roll and a second portion of the web is arranged against the lands.

14. An under screen cleaning apparatus for wiping a stencil of a screen printer, the wiping apparatus comprising:

an elongated vacuum channel;

a pair of elongated blades attached to respective sides of the vacuum channel; and adapter means for converting top edges of the elongated blades to a cleaning head surface, the cleaning head surface including at least three elongated lands.

* * * * *